US006571951B2

(12) United States Patent
Levine et al.

(10) Patent No.: US 6,571,951 B2
(45) Date of Patent: Jun. 3, 2003

(54) ROTATING DISPENSER FOR MULTIPLE ITEMS OF VARIOUS SIZES

(76) Inventors: Frances Joy Levine, 311 Denison St., Highland Park, NJ (US) 08904-2731; David S. Levine, 311 Denison St., Highland Park, NJ (US) 08904-2731

( * ) Notice: Subject to any disclaimer, the term of this patent is extended or adjusted under 35 U.S.C. 154(b) by 0 days.

(21) Appl. No.: 09/887,485

(22) Filed: Jun. 22, 2001

(65) Prior Publication Data

US 2002/0195457 A1 Dec. 26, 2002

(51) Int. Cl.[7] ..... B65D 85/67
(52) U.S. Cl. ..... 206/395; 206/397
(58) Field of Search ..... 206/229, 395, 206/396, 397, 526; 221/46

(56) References Cited

U.S. PATENT DOCUMENTS 3,718,251 A * 2/1973 Barnett ..... 206/229
4,364,490 A * 12/1982 Lang et al. ..... 206/390
4,519,502 A * 5/1985 Jackson et al. ..... 206/390
4,995,530 A * 2/1991 Tabor ..... 221/281
5,904,329 A * 5/1999 Kanome et al. ..... 206/395
5,927,488 A * 7/1999 Gray ..... 206/237

* cited by examiner

*Primary Examiner*—David T. Fidei

(57) ABSTRACT

A dispenser container for simultaneously holding and dispensing different sized items, such as plastic bags, that are usually packed by same size individually side-by-side or in a roll, with a box to be dispensed from the box via a slot or aperture. The dispenser and hanging-rotating device's double side panel holes allow for the unit to be shipped compactly, yet set-up for rotating and dispensing. This dispenser's compartments allow for different sized items to be dispensed from their own slot on each longitudinal axis. In addition, the dispenser includes an axle, referred to as a "protrusion," that allows for the box to rotate on its axis, therefore giving the user easy access to the desired sized item. The device can be mounted vertically, horizontally, or otherwise for the convenience of the user. The entire design and apparatus can either be disposable or of a more permanent, refillable nature.

26 Claims, 2 Drawing Sheets

ROTATING DISPENSER FOR MULTIPLE ITEMS OF VARIOUS SIZES

TECHNICAL FIELD

This invention relates to a dispenser wherein a plurality of items of varying sizes, such as plastic storage bags, are held together on a rotating axis within a mounting unit, for withdrawing a selection of different sized items.

BACKGROUND OF THE INVENTION

Several types and sizes of like or complimentary items are often needed. As these items vary in both size and source, their proximity to the user might not be apparent or convenient. By creating a system wherein several types and sizes of like or complimentary items can be placed for easy extraction, this problem can be solved. For purposes of demonstration and illustration, the example of plastic storage bags is used. However, it should not be taken as the invention's only use.

For example, disposable plastic storage bags are often provided in roll form or packed tightly side by side within a cardboard disposable box. Plastic storage bags come in varying sizes and the cardboard boxes which contain them, also have varying dimensions though they are typically rectangular or square in cross-sections. Disposable storage bags can be clear or colored, tie or zip lock. These bags are used for storing a multitude of food and non-food items. Many commercially available disposable cardboard boxes containing plastic bags provide a longitudinally extending slot. The slot is usually closed when the box is purchased and by tearing off a perforated cardboard section the user opens the slot. Storage bags are commercially available and are sold under various trademark and private label brands. There are some more permanent dispensers on the market with pre-set openings into which the box of bags is inserted. The dispenser can then be mounted in a convenient location.

It is a fact that these boxes differ in dimensions dependent on manufacturer, quantity, and bag size/type. A chaotic and sloppy storage problem is created when a particular household has storage bags, which are of various sizes contained in various sized boxes. Typically, these boxes are stacked on shelves or stuffed in drawers where they are difficult to access and generally create clutter.

Prior art describes fixed mounted units into which a roll might be inserted, for example paper towel.

Prior art is concerned with the problem of dispensing loose items, which are not contained within an overall disposable box structure that can be of various sizes. When products are put inside of a dispenser, which is specifically sized to contain the particular product being dispensed, it is thus not able to handle product variation.

The Tabor U.S. Pat. No. 4,995,530 is designed as device that can hold and dispense bags from various sized boxes. However, while it is designed to adjust to the size of the box, it dispenses only one size bag that is dependent on the contents of the inserted box.

Commonly, with the wide variety of some like items, such as plastic bags (i.e.: trash bags, storage bags, etc.), the size of the item varies widely as does the size of their containers. These prior art references do not provide to have multiple sized items dispensed from one convenient container. The present invention accomplishes this so that items of various sizes can be dispensed within a single device, located conveniently within the mounting system.

SUMMARY OF INVENTION

The present invention provides for a system in which: (a) holes on the dispenser interlock on the mounting unit allow for flush, compact shipping and display, and are raised to allow for rotation on its axis for easy access to all the chambers; and (b) offers variable sized internal lengths of the dispenser and slots or apertures to accommodate the varying sized items within. The present invention can be mounted vertically, horizontally, or otherwise, for the convenience of the user. The entire design and apparatus can either be disposable or of a more permanent refillable nature. The apparatus includes:

1. A mounting unit that allows the dispenser to rotate on its axis for easy access to each of the chambers.
2. A dispenser with two holes (one off-center, the other on-center) on each end flap of the mounting unit.
3. An internal system of chambers that can accommodate various lengths with corresponding appropriately sized perforated slots in the disposable apparatus and pre-cut slots or apertures in the more permanent apparatus, corresponding to the size of the items contained in the corresponding chamber.

Using a system of dye-cuts and folds in the disposable apparatus, or formed walls in a more permanent embodiment, the chambers are created to the desired length. A cardboard (or other appropriate material) box in a disposable apparatus, or a formed box in a more permanent apparatus, having two holes for the mounting unit on the ends and appropriately sized perforated or pre-cut slots/apertures corresponding to each chamber encases the said chambers. A U-shaped mounting unit, with a hook and loop fastener attached (or double-sided tape or mounting holes drilled in) at the top mounting side, and protrusions on the internal side of the two shorter extensions of the U-shape mounting unit, is placed in the off-center of the two end holes for shipping and display. Subsequently, the extensions are then moved to the center end holes for mounting and easy access so that items of varying sizes can be dispensed simultaneously through the appropriate slots.

DETAILED DESCRIPTION OF THE INVENTION

Figure 1:
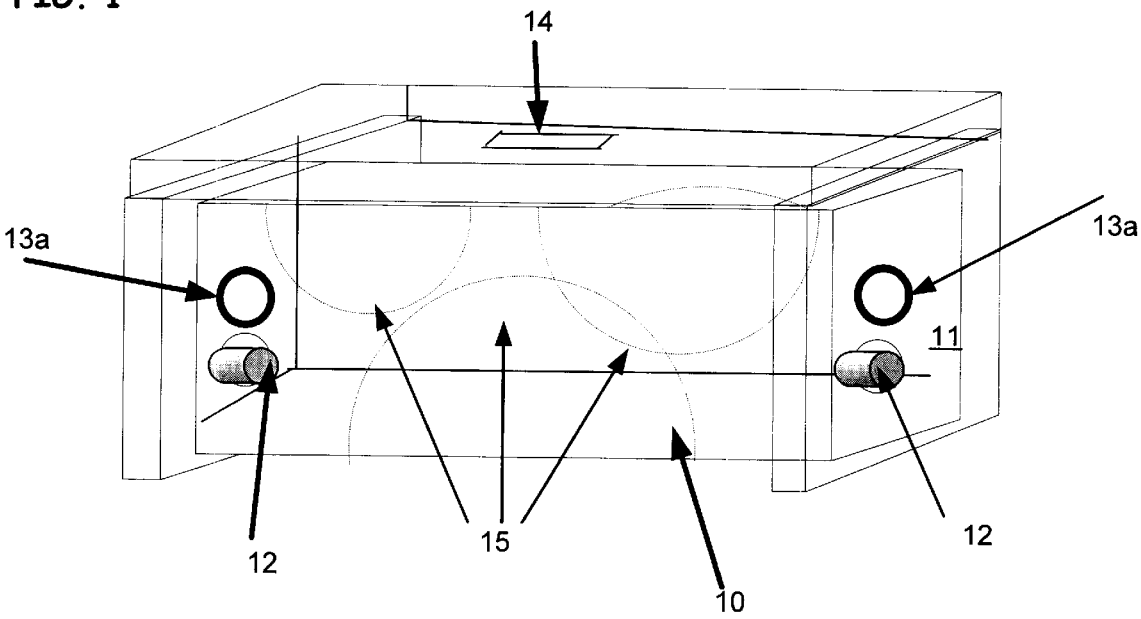
FIG. 1 is a view of the preferred embodiment of the apparatus of the present invention in its shipping and display configuration.
Figure 2:
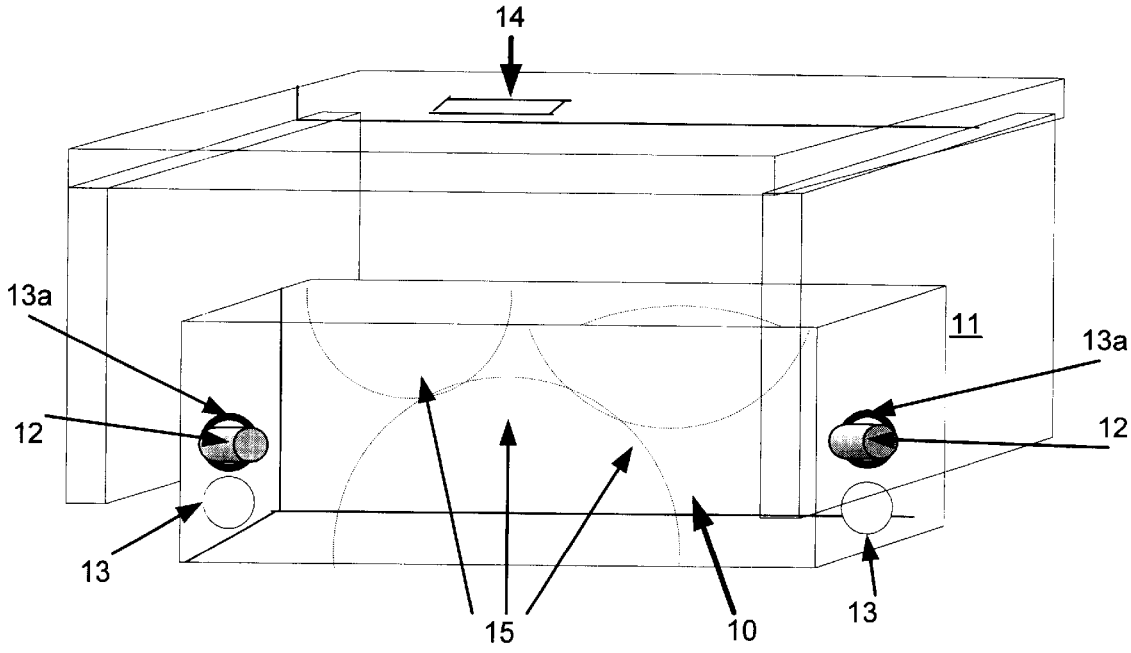
FIG. 2 is a view of the preferred embodiment of the apparatus of the present invention in its deployed configuration.

FIGS. 1 and 2 best illustrate the preferred embodiment of the apparatus of the present invention designated generally by the numerals 10 (the dispenser) and 11 (the mounting unit).

The dispenser container 10 includes a) perforated or pre-cut slots/apertures 15 and b) holes 13, 13*a*. 13*a* indicates that a tube or ring has been inserted in the hole to allow for easy rotation of 10 when mounted. The center holes 13*a* and off-center holes 13 are made to accommodate c) the protrusions 12. The protrusions 12 are inserted in the holes 13 while shipping and displayed and moved to the holes 13*a* after mounting for use.

The mounting is accomplished by d) either hook and loop fasteners or double-sided tape 14 or pre-drilled holes (for screws, nails, or the like) for attaching the housing 11 to a flat surface.

Figure 3:
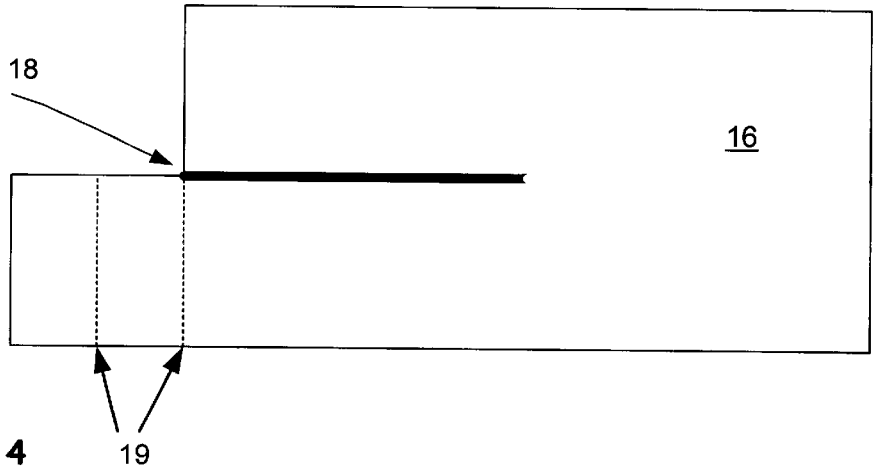
FIG. 3, FIG. 4 and FIG. 5 are a series of views as to how different sized chambers would be created in a disposable embodiment.
Figure 4:
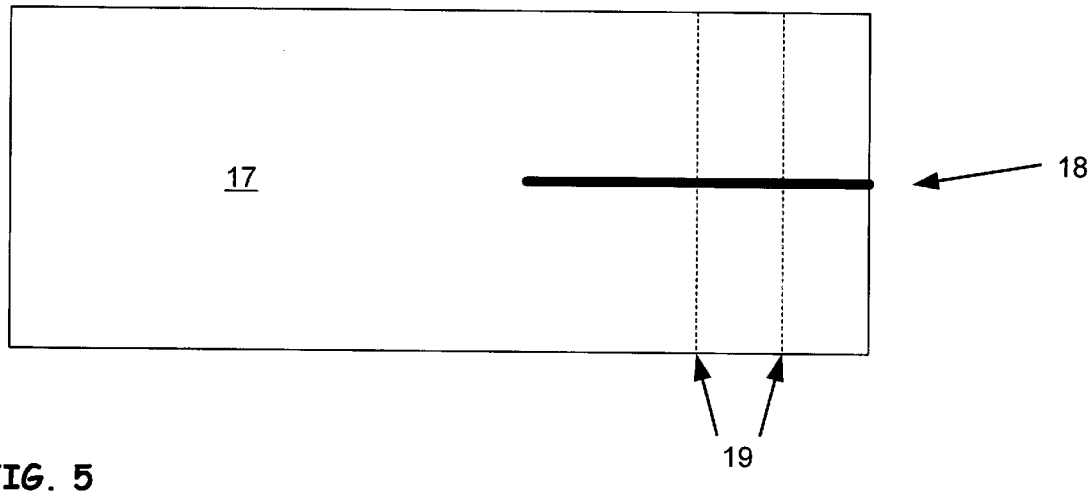
Figure 5:
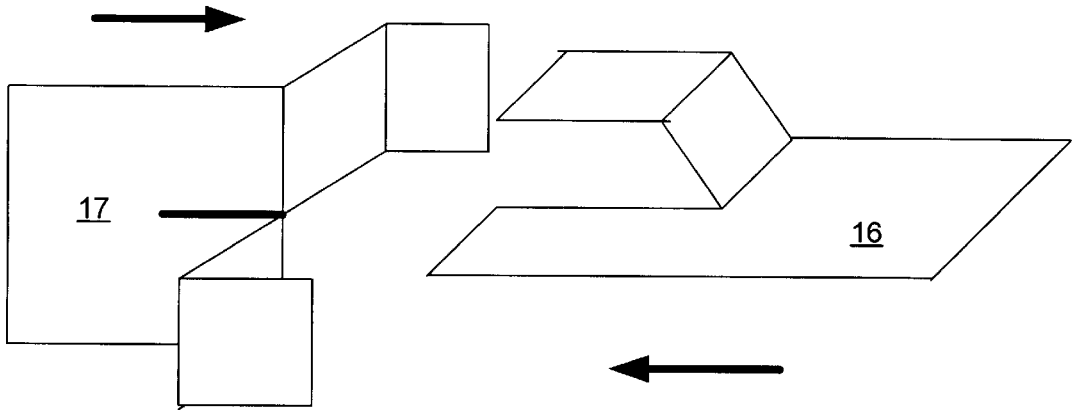

For the disposable embodiment, the adjustable system of chambers (FIG. 3, FIG. 4, FIG. 5) shows how e) two flat and folded inserts 16, 17 are f) cut 18, and g) folded 19, and then interlocked to create the system of chambers. This system is then inserted into 10. For the more permanent embodiment, these chambers may be part of the mold.

One skilled in the art will thus notice that 10 easily inserts into 11 and rotates freely for easy access to any of the contained material.

The apparatus 10 and 11 can be manufactured of any suitable material such as cardboard, wood, plastic, metal, or the like.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A dispenser container formed in such a way as to be able to be engaged by a mounting unit means that supports said container but allows said container to rotate on an axis, there being formed in at least two sides of said container two or more apertures through which items within the container can be dispensed.

2. The dispenser container of claim 1 wherein said dispenser container has one or more sides and first and second ends, and wherein each end is formed in such a way as to be able to be engaged by said mounting unit means.

3. The dispenser container of claim 2 wherein each said end has formed in the center thereof a hole engageable by said mounting unit means.

4. The dispenser container of claim 3 wherein each said end includes a ring inserted in said hole.

5. The dispenser container of claim 3 wherein each said end includes a tube inserted in said hole.

6. The dispenser container of claim 3 further comprising means within the container for creating two or more chambers in the interior of the container, each said aperture being positioned in such a way that items in a corresponding one of the chambers can be dispensed through that aperture.

7. The dispenser container of claim 6 wherein two or more of said chambers are of different sizes.

8. The dispenser container of claim 2 wherein said container has a plurality of sides in addition to said first and second ends and at least two of said sides have formed therein at least a respective one of said apertures.

9. The dispenser container of claim 2 wherein at least one of said sides has formed therein at least two of said apertures.

10. The dispenser container of claim 2 wherein at least one of said apertures is positioned along a longitudinal edge of said container.

11. Apparatus comprising a container having a plurality of sides and first and second ends, each end including engaging means, each said engaging means being adapted to engage a respective support for said dispenser which allows said dispenser to rotate on a central axis thereof, there being formed, in each at least two of said sides, at least one aperture through which items within the dispenser can be dispensed.

12. The apparatus of claim 11 wherein said engaging means is on said axis and includes at least one of a hole, a ring and a tube.

13. The apparatus of claim 11 further comprising means for defining two or more chambers in the interior of the dispenser that have respective different lengths, each said aperture being positioned in such a way that items in a corresponding one of the chambers can be dispensed through that aperture.

14. The apparatus of claim 13 wherein there is formed, in at least one of said sides, at least two of said apertures.

15. The apparatus of claim 13 further comprising a plurality of items of a particular size contained within a first one of said chambers, and a plurality of the same kind of items, but of a different size, contained within a second one of said chambers.

16. The apparatus of claim 15 wherein said items are plastic bags.

17. The apparatus of claim 13 further comprising a mounting unit adapted to be attached to a mounting surface and having first and second extensions, each of which includes a respective one of said supports.

18. The apparatus of claim 17 wherein said mounting unit is U-shaped and further has a top side adapted to be attached to said mounting surface and from which said extensions extend.

19. The apparatus of claim 18 wherein each end includes further means not on said axis for engaging said respective support.

20. Apparatus comprising, a U-shaped mounting unit having a side adapted to be attached to a mounting surface and having first and second extensions a dispenser having a pair of opposing ends and at least one dispensing surface, the opposing ends being engageable at their centers with a respective one of the extensions in such a way that said dispenser can be rotated around an axis, said dispenser including means forming at least two internal chambers and said dispensing surface having formed therein at least two apertures, each aperture providing access to a respective one of said chambers from outside of said dispenser.

21. The apparatus of claim 20 wherein said dispenser is a box and wherein said dispensing surface comprises a plurality of rectangular sides of said box, at least one said aperture being formed in each of at least two of said sides.

22. The apparatus of claim 21 further comprising a plurality of plastic storage bags of a particular size contained within a first one of said chambers, and a plurality of plastic storage bags of a different size contained within a second one of said chambers.

23. The apparatus of claim 20 wherein said extensions include respective protrusions each adapted to engage a respective one of said opposing ends.

24. The apparatus of claim 23 wherein each of said opposing ends has an interlock element comprising at least one of a hole, a ring and a tube at the center thereof and engageable with a respective one of said protrusions.

25. The apparatus of claim 24 wherein said mounting unit and said dispenser are such that said dispenser can fit within the mounting unit, with the mounting unit flush against said dispensing surface.

26. The apparatus of claim 24 wherein each of said opposing ends has a second interlock element including at least one of a hole, a ring and a tube not at the center thereof and engageable with a respective one of said protrusions in such a way that said dispenser can be held with the mounting unit flush against said dispensing surface.

* * * * *